US012150607B2

(12) United States Patent
Silvers

(10) Patent No.: US 12,150,607 B2
(45) Date of Patent: Nov. 26, 2024

(54) AUTOMATED DISPOSABLE DISPENSER

(71) Applicant: Mark J. Silvers, Hartford, CT (US)

(72) Inventor: Mark J. Silvers, Hartford, CT (US)

( * ) Notice: Subject to any disclaimer, the term of this patent is extended or adjusted under 35 U.S.C. 154(b) by 120 days.

(21) Appl. No.: 18/049,397

(22) Filed: Oct. 25, 2022

(65) Prior Publication Data

US 2024/0023762 A1 Jan. 25, 2024

Related U.S. Application Data

(60) Provisional application No. 63/390,464, filed on Jul. 19, 2022.

(51) Int. Cl.
*A47K 5/12* (2006.01)

(52) U.S. Cl.
CPC ..... *A47K 5/1217* (2013.01); *A47K 5/1202* (2013.01)

(58) Field of Classification Search
CPC ... A47K 5/1217; A47K 5/1202; B65D 83/262
See application file for complete search history.

(56) References Cited

U.S. PATENT DOCUMENTS

| | | | | |
|---|---|---|---|---|
| 2006/0231568 | A1* | 10/2006 | Lynn | A47K 5/1202 222/638 |
| 2007/0000941 | A1* | 1/2007 | Hadden | A47K 5/1217 222/63 |
| 2009/0140004 | A1* | 6/2009 | Scorgie | A47K 5/1217 222/638 |
| 2016/0242601 | A1* | 8/2016 | Del Rosario | C11D 17/046 |
| 2019/0059659 | A1* | 2/2019 | Burgo, Sr. | A47K 5/1217 |
| 2021/0030216 | A1* | 2/2021 | Ophardt | A47K 5/1211 |

* cited by examiner

*Primary Examiner* — Donnell A Long

(57) ABSTRACT

The present invention relates generally to the field of single use, disposable dispensers. The dispenser has a housing, with an interior space, a one cap, and a motion sensor. The dispenser further allows a user to have hands-free dispensing of the desired liquid, while still having an easily disposable single-use dispenser. The dispenser may include a one light source, a motor. The motor pulls the liquid through the straw and out of the continuous opening to the nozzle. The motor, light source, and the motion sensor may be powered by a battery.

13 Claims, 5 Drawing Sheets

AUTOMATED DISPOSABLE DISPENSER

CROSS-REFERENCE TO RELATED APPLICATION

The present application claims priority to, and the benefit of, U.S. Provisional Application No. 63/390,464, which was filed on Jul. 19, 2022, and is incorporated herein by reference in its entirety.

FIELD OF THE INVENTION

The present invention relates generally to the field of dispensers. More specifically, the present invention relates to an automated disposable dispenser for dispensing cleansing products. The dispenser has a housing, an interior space, at least one cap, and at least one motion sensor. The invention further allows a user to have hands-free dispensing of the desired material such as a liquid, while still maintaining an easily disposable body or housing. The device further may include at least one light source for easy use in poor lighting. Further, the interior space has at least one straw for drawing from a reservoir or supply of material and at least one motor. The straw, the cap, the nozzle, and the continuous opening are in fluid communication, and the motor pulls the liquid through the straw and out of the continuous opening. The motor may contain a meter to limit the amount of material being dispensed as well as a timer to prevent dispensing in quick sequences, such as if a house pet walks by the dispenser or child is playing with the dispenser. The motor, light source, and the motion sensor may be powered by at least one battery. Accordingly, the present disclosure makes specific reference thereto. Nonetheless, it is to be appreciated that aspects of the present invention are also equally applicable to other like applications, devices, and methods of manufacture.

BACKGROUND

Dispenser bottles for hand soap, sanitizer, laundry detergent, beverages, cleaning and sanitizing agents and other liquids that require users to apply pressure on the dispenser nozzle to dispense the material. The nozzle can carry a multitude of germs, viruses, and bacteria due to different individuals using the dispenser or alternatively, the failure of an individual to wash their hands prior to using the nozzle. Other dispenser bottles require a cap to be unscrewed which also may be covered in germs, viruses, and bacteria. Automated dispensers generally have to be cleaned after use and refilled. Automated dispensers can be large and may take up a lot of space. Further, automated dispensers are usually expensive and can cost a significant amount of money to replace if they are broken or cannot be cleaned.

Therefore, there exists a long-felt need in the art for an improved automated dispenser. Further, there exists a long-felt need in the art for an automated disposable dispenser that allows a user to access the desired liquid of their choice without having to apply pressure to the nozzle or other valve. There also exists a long-felt need in the art for an automated disposable dispenser device that is recyclable. There also exists a long-felt need in the art for an automated disposable dispenser device that is prefilled thus saving the user's time. There also exists a long-felt need in the art for an automated disposable dispenser device that is affordable and fits easily onto any size surface. There also exists a long-felt need in the art for an automated disposable dispenser device that allows for hands free dispensing of the desired liquid.

The subject matter disclosed and claimed herein, in one embodiment thereof, comprises an automated disposable dispenser. The device has a housing for holding a supply of material or a reservoir, at least one cap, and at least one nozzle. Further, the housing has at least one motion sensor to allow the device to detect the user's hand for touchless dispensing. The device further includes at least one light source allowing a user to be able to see in poor lighting conditions. The interior space of the device has a straw and at least one motor that pulls the liquid through the straw and out of the continuous opening positioned in the nozzle. The motor may also have a meter and timer to control the amount of material dispensed and the meter and timer may be set to work to dispense different amounts or require pre-determined amount of time between each dispensing cycle.

In this manner, the automated disposable dispenser of the present invention accomplishes all of the foregoing objectives and provides a novel automated disposable dispenser. The dispenser allows for touchless dispensing of the desired liquid. Further, the device is recyclable and is easily disposable for minimal clean up.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The subject matter disclosed and claimed herein, in one embodiment thereof, comprises an automated disposable dispenser. The dispenser has a housing with walls defining an interior area for holding a supply of material or a removable reservoir for holding the supply of material. The housing further includes a bottom surface, at least one grip area, at least one motion sensor, at least one light source, at least one battery, and at least one fastener. The housing has a top end for a dispensing nozzle.

The invention has a housing. The housing may include at least one grip area, a bottom surface, walls defining an interior area and at least one fastener. In the preferred embodiment, the housing is manufactured from a lightweight recyclable plastic or plastics that have been produced from recycled materials. The housing may also be constructed from a biodegradable, plant-based material so as to be easily compostable. The housing may be provided with one or more gripping areas which may be a non-slip rubber or silicone material. The housing has a bottom surface, with at least one fastener and a top end for a dispenser nozzle. The fastener may be positioned on the bottom surface and may be attached to the surface in which the user wishes to place the dispenser. This prohibits the device from falling over if it is bumped.

The housing includes at least one motion sensor. The motion sensor senses movement from an individual and activates the light source and/or the motor. The light source and motor may be activated so as to operate simultaneously, substantially simultaneously, sequentially or wholly independently from one another. Once a user places their hand, silverware, dishware, or other object under the motion sensor, the device dispenses the desired liquid. The device may include a light source. The light source may be activated by the motion sensor or may be turned on and off by the individual user. This allows an individual to use the device even when there is minimal lighting. The motion sensor, light source, and the motor are all powered by at least one battery. The device further includes at least one cap. The cap also has a nozzle or other valve to allow for the egress of material from the supply of material contained within the housing. The nozzle or valve has at least one continuous opening. The continuous opening permits the dispensing of the material.

The device further includes an interior space defined by walls making up the exterior of the dispenser. The interior space further includes at least one straw. The straw further allows the liquid to travel from the interior space and material supply or reservoir through the cap and out of the continuous opening located in the nozzle or valve. Further, the straw, cap, nozzle, and continuous opening are in fluid communication. The device has a motor located in the interior space. The motor functions to pull the liquid through the straw and out of the continuous opening in the nozzle. The motor may also have a metering function and timer to control the amount, duration, and intervals of dispensing.

In one embodiment, the device is insulated. In the insulated embodiment, the dispenser has an insulated housing to keep the liquid either hot or cold within the interior space. In one embodiment, the insulated housing may have multiple layers of insulating metal. In another embodiment, the insulated housing may be vacuum sealed for even greater insulation. In varying embodiments, the insulated embodiment, may have an array of different components such as a threaded cap without a nozzle. In this embodiment, the cap may be twisted on and off the insulated housing to access the liquid.

In the insulated embodiment, the device may have at least one dial that may be twisted to allow a user to know whether the liquid is hot or cold within the interior space. Further, the dial may have indicia, such as a temperature readout provided by a thermometer that displays the temperature of the liquid.

Accordingly, the automated disposable dispenser device of the present invention is particularly advantageous as it provides a novel dispenser that allows a user to dispose of the dispenser. Further, the device provides a way to operate the dispenser in a hands-free manner. In this manner, the automated disposable dispenser overcomes the limitations of existing dispensers known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1A:
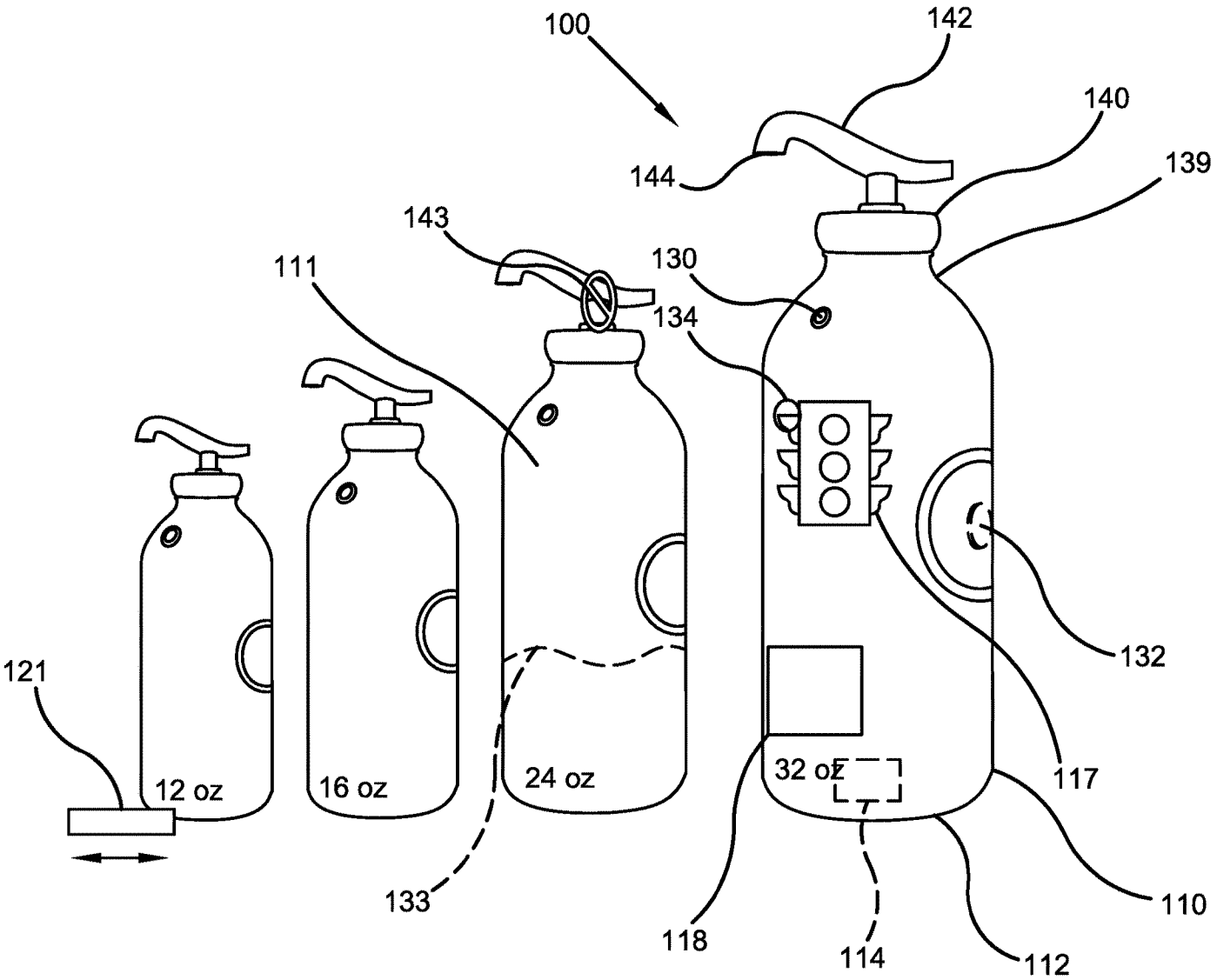
FIG. 1A illustrates a perspective view of one potential embodiment of an automated disposable dispenser of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for an improved automated dispenser. Further, there exists a long-felt need in the art for an automated disposable dispenser that allows a user to access the desired liquid of their choice without applying pressure to the nozzle or release valve. There also exists a long-felt need in the art for an automated disposable dispenser that is recyclable, and disposable. There also exists a long-felt need in the art for an automated disposable dispenser that is prefilled, thereby saving the user time at the time of purchase. There also exists a long-felt need in the art for an automated disposable dispenser that is affordable and fits easily onto any size surface and may be readily carried or transported. There also exists a long-felt need in the art for an automated disposable dispenser that allows for hands-free dispensing of the desired liquid or other solution.

The present invention, in one exemplary embodiment, is comprised of an automated disposable dispenser. The device includes a housing having walls defining an interior area for holding a supply of material. The housing is preferably rigid or semi-rigid and has a bottom surface, a top end for dispensing the solution, at least one fastener, at least one gripping area, at least one light source, at least one battery, and at least one motion sensor. The housing of the device has an interior space which contains at least one straw and at least one motor. The motor pulls the liquid up the straw, through the cap located on the top end of the housing, and out of the continuous opening located in the nozzle or valve. Further, the straw and the continuous opening are in fluid communication. In one embodiment, the dispenser has an insulated housing. The insulated housing keeps the liquid either cold or hot depending on what the user wants or the requirements of the material supply to preserve freshness or to dispense the solution at its optimum temperature. In the insulated embodiment, the device may have a dial, with indicia that allows the user to display whether the liquid is hot or cold as well as a thermometer or other indicator to show the actual temperature of the solution contained within the housing. The motor may also have a meter and timer, each of which may be set to a predetermined configuration to control the amount of solution dispensed. The light source may also be displayed in several different levels such as red, yellow, green or different light levels bright, medium, low which can be used to alert the user to the level of solution remaining in the container.

Referring initially to the drawings, FIG. 1A illustrates a perspective view of one potential embodiment of an automated disposable dispenser 100 of the present invention in accordance with the disclosed. The dispenser 100 is designed to be a single use device and has a housing 110, with a bottom surface 112, at least one grip area 118, at least one motion sensor 130, at least one light source 134, at least one battery 132, and at least one fastener 114. The light source 134 may be provided in the form of a light indicator 117 which can show the user the amount of solution remaining in the dispenser 100. The light indicator 117 may be provided to show red, green, yellow, or bright, medium, and low lighting.

Figure 2:
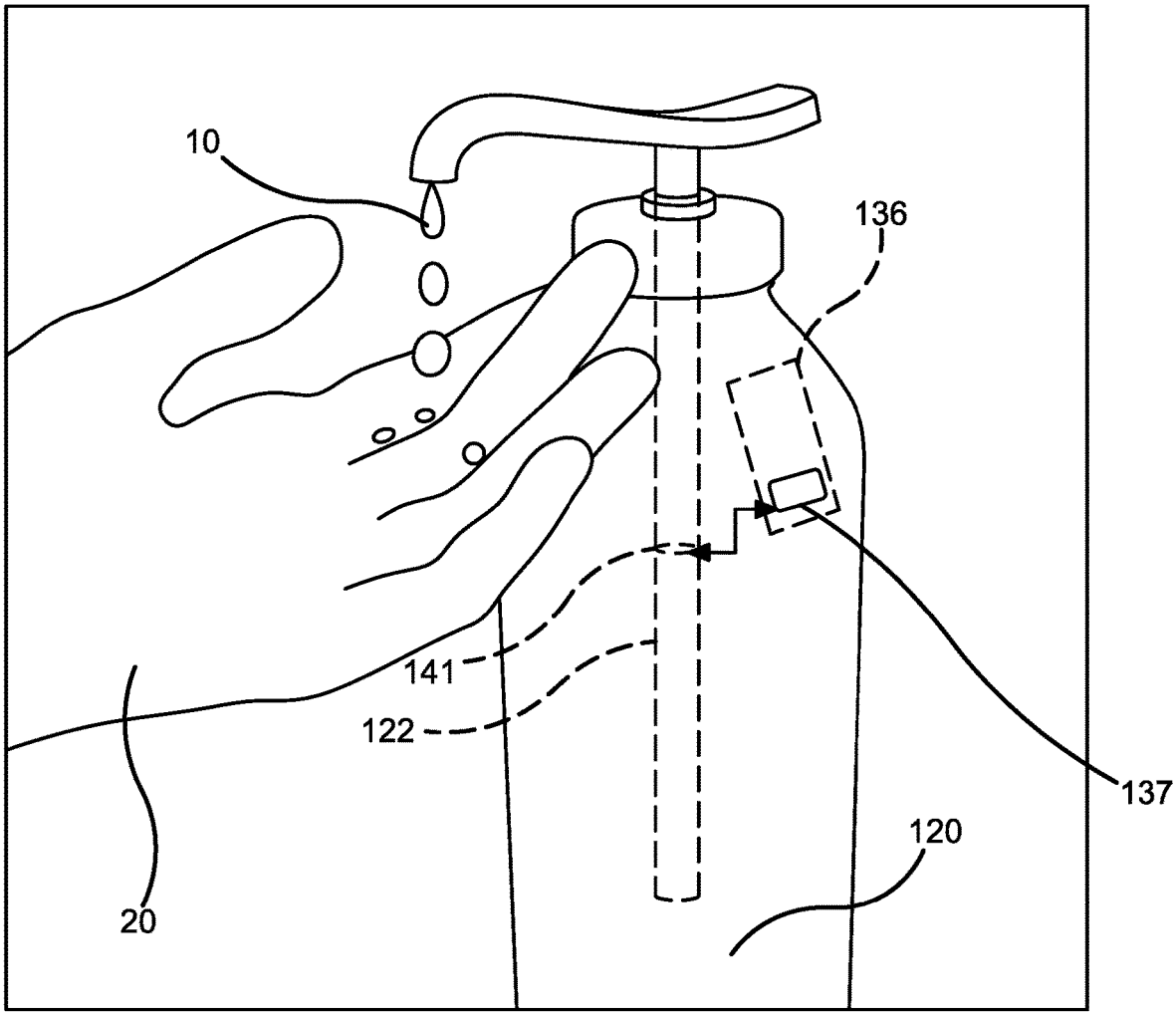
FIG. 2 illustrates a perspective view of one potential embodiment of an automated disposable dispenser of the present invention in use in accordance with the disclosed architecture.

The dispenser 100 has a housing 110 with walls 111 to define an interior space or cavity which houses a reservoir or material or solution supply 133 (see FIG. 2). The housing may have at least one grip area 118, a bottom surface 112, and at least one fastener 114. In the preferred embodiment, the housing 110 is manufactured from a lightweight recyclable plastic such as, but not limited to: polyethylene terephthalate, high density polyethylene, low-density polyethylene, polypropylene, polystyrene, biodegradable plastics, recycled plastics, or combinations thereof. In another embodiment, the housing 110 may be manufactured from any rigid or semi-rigid plastic known in the art such as, but not limited to: acrylic, polycarbonate, thermoplastic, acrylonitrile butadiene styrene, medium-density polyethylene, polyvinyl chloride, polylactic acid, acetal, nylon, fiberglass, or combinations thereof. The housing 110 may also be made from recycled plastics, compostable plastics such as plant based plastic material. The housing 110 may be provided with one or more gripping areas 116 which may be a non-slip rubber material such as, silicone, latex, neoprene, EPDM, PVC foam, polyethylene, sponge rubber, silicone foam, urethane, cork, ridged rubber, felt, acrylic, polyester & SBR, or combinations thereof. The gripping area 116 may have a series of undulating ridges or other patterns to facilitate holding and gripping of the housing 110.

The housing 110 may be manufactured in any size or shape known in the art, but in the preferred embodiment, the device 100 is generally cylindrical in shape, and has a diameter and comes in a variety of different sizes. The housing 110 has a bottom surface 112 and a top 139. The bottom surface 112 may have at least one fastener 114. The fastener 114 may be positioned on the bottom surface 112 and may be attached to the surface in which the user wishes to place the device 100. This prohibits the device 100 from falling over if it is bumped. The fastener 114 may be any fastener known in the art such as magnetic, suction cup, removable or repositionable adhesives, hook and loop fasteners, or combinations thereof.

The housing 110 has at least one motion sensor 130. The motion sensor 130 may be any motion sensor such as, but not limited to: passive infrared sensor, ultrasonic sensor, microwave sensor, tomographic sensor, or any combination thereof. The motion sensor 130 senses movement from an individual and activates the light source 134 or the motor 136. Once a user places their hand 20, silverware, dishware, or other object under the motion sensor 130, the device 100 dispenses the desired liquid or solution 10. The dispenser 100 may include a light source 134. The light source 134 may be any light source known in the art such as LED light, LCD light, fluorescent light, white light, spotlight, area light, fiber optic illuminator, incandescent, or halogen. The light source 134 is further activated by the motion sensor 130. This allows a user to use the device 100 even when there is minimal lighting. The light source 134 may also use a light indicator 117 in order to show the user how much solution remains in the container.

The motion sensor 130, light source 134, and the motor 136 are all powered by at least one battery 132. In the preferred embodiment, the battery 132 is in the form of a cell battery. In differing embodiments, the battery 132 may be a disposable battery 132 or a rechargeable battery 132 in the form of an alkaline, nickel-cadmium, nickel-metal hydride battery 132, etc., such as any 3V-12 volts DC battery 132 or other conventional battery 132 such as A, AA, AAA, etc., that supplies power to the device 100. Throughout this specification the terms "battery" and "batteries" may be used interchangeably to refer to one or more wet or dry cells or batteries 132 of cells in which chemical energy is converted into electricity and used as a source of DC power. References to recharging or replacing batteries 132 may refer to recharging or replacing individual cells, individual batteries 132 of cells, or a package of multiple battery cells as is appropriate for any given battery 132 technology that may be used.

The dispenser 100 has at least one cap 140 located on the top 139 of the housing 110. The top 139 has a reduced diameter to that of the housing from a half to a third less than the housing diameter. The cap 140 may be in any form but in the preferred embodiment, the cap 140 is a threaded cap 140 that screws onto the reciprocating threads located on the housing 100. The cap 140 is provided on the top end 139 which has a reduced diameter of the housing 110 and is about one-half to one-third of the diameter of the housing. The cap 140 includes a nozzle 142 extending upwardly from the cap. The nozzle 142 has at least one continuous opening 144. The nozzle may also include a coating of antimicrobial material or may be made from an antimicrobial material to limit the transmission of germs or bacteria. The nozzle has a dial 143 which allows the user to change the flow of the material being dispensed from a solution to a foam, or simply to turn off the flow. The continuous opening 144 is where the liquid 10 is dispensed from. In one embodiment, the device 100 is automated via motor 136 which will be discussed further in connection with FIG. 2. In another embodiment, the device is automated via a motor 136, but also the nozzle 142 may be pushed down thus pushing liquid 10 through the nozzle 142 and out the continuous opening 144. The cap 140 and nozzle 142 are preferably manufactured from recyclable plastic such as, but not limited to: polyethylene terephthalate, high density polyethylene, low-density polyethylene, polypropylene, polystyrene, biodegradable plastics, recycled plastics, or combinations thereof.

Figure 1B:
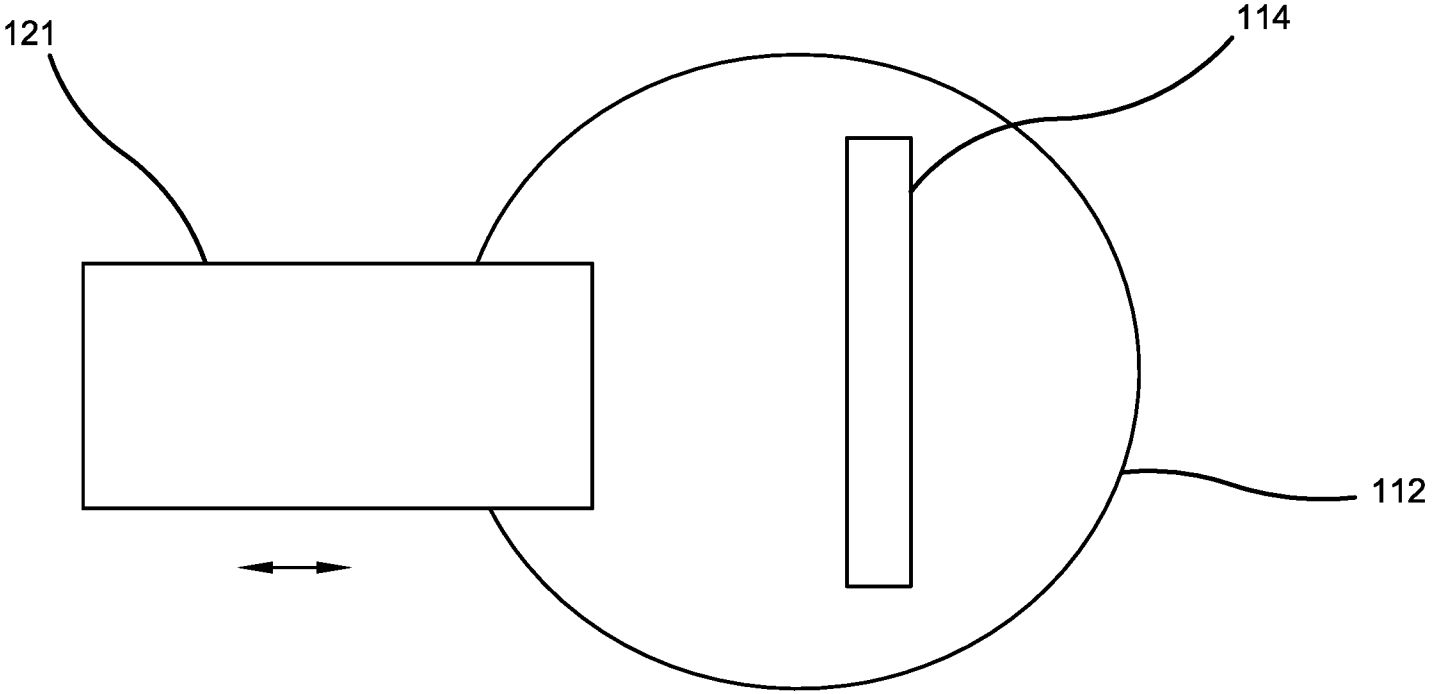
FIG. 1B illustrates a perspective view of the bottom surface of the container showing a collection tray and fastener.

FIG. 1B illustrates the bottom 112 of the housing 110 depicting the movable catch tray 121 which can be slide out from the bottom 112 to catch solution that is dispensed so that is does not land on the counter or surface to which the dispenser is placed. FIG. 1B also shows the fastener 114 which may be magnetic, suction cup, removable or repositionable adhesives, hook and loop fasteners, or combinations thereof.

FIG. 2 illustrates a perspective view of one potential embodiment of an automated disposable dispenser 100 of the present invention in use in accordance with the disclosed specification. The device 100 has an interior space 120 which is defined by walls 111, bottom surface 112 and a top 139. The interior space 120 has at least one straw 122. The straw 122 allows the liquid or solution 10 to travel from the material supply or reservoir 133 contained in interior space 120 through the cap 140 and out of the continuous opening 144 located in the nozzle 142. Further, the straw 122, cap 140, nozzle 142, and continuous opening 144 are in fluid communication. In the preferred embodiment, the straw 122 further is manufactured from a recyclable plastic such as, but not limited to: polyethylene terephthalate, high density polyethylene, low-density polyethylene, polypropylene, polystyrene, biodegradable plastics, recycled plastics, or combinations thereof.

The device 100 has a motor 136 located in the interior space 120. The motor 136 functions to draw or pull the liquid or solution 10 through the straw 122 and out of the continuous opening 144 in the nozzle 142. The motor 136 may be any motor known in the art such as, but not limited to: brushed DC motor, brushless DC motor, micro stepped motor, linear stepped motor, shunt motor, series motor, compound motor, AC motor, PDMC motor, induction motor, synchronous motor, hysteresis motor, reluctance motor, etc. The motor 136 may have a timer and meter 137 which is connected to a flow regulator 141 so that a user can set a predetermined amount of solution to be dispensed from the reservoir 133 or to regulate the time between the next dispensing cycle to prevent a child playing with the dispenser from over activating the dispenser.

Figure 3:
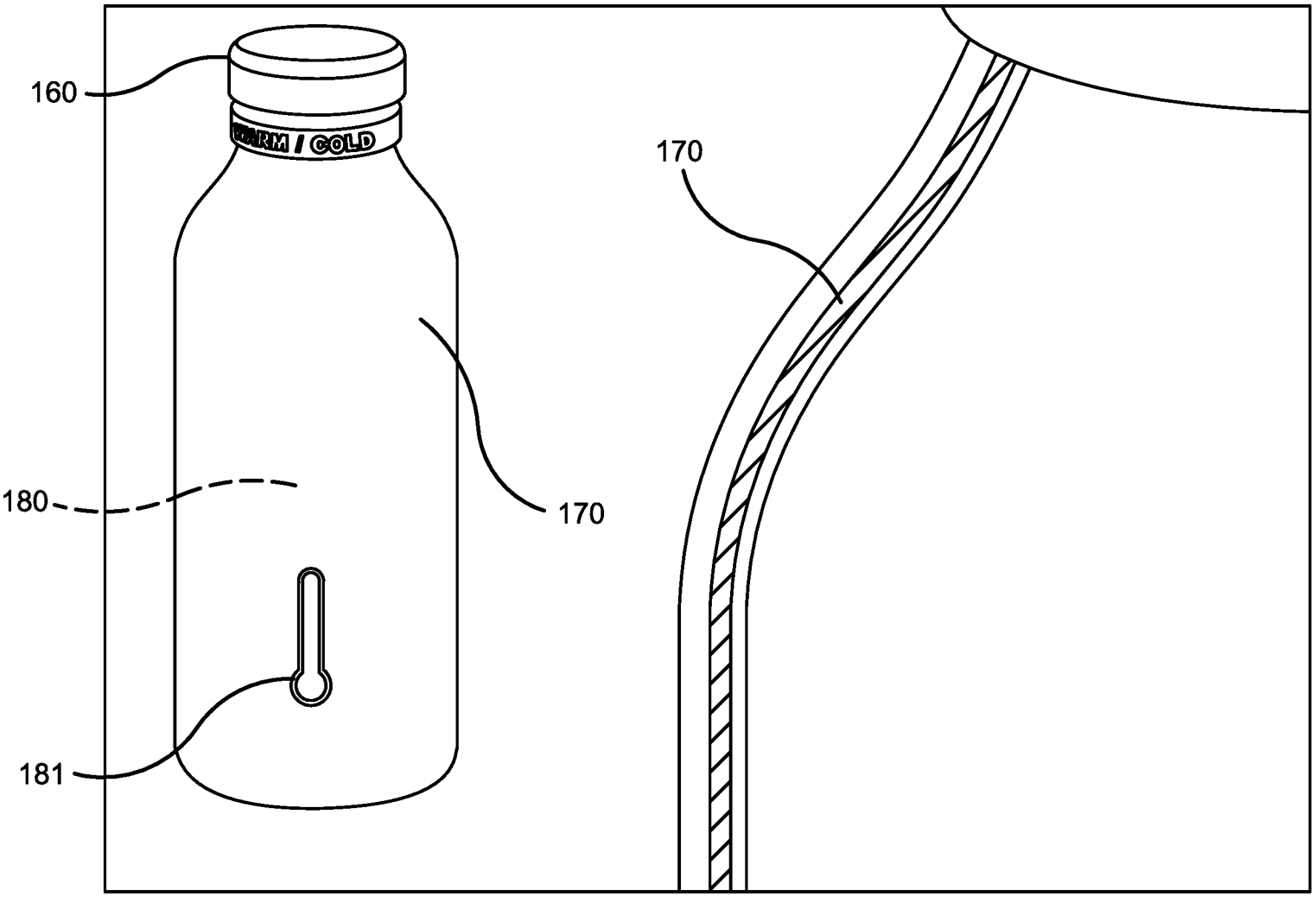
FIG. 3 illustrates an exploded side view of one potential embodiment of an automated disposable dispenser with an insulated housing of the present invention in accordance with the disclosed architecture.

FIG. 3 illustrates an exploded side view of one potential embodiment of an automated disposable dispenser 100 with an insulated housing 170 of the present invention in accordance with the disclosed specification. In one embodiment, the dispenser 100 is insulated. In the insulated embodiment, the dispenser has an insulated housing 170 that keeps the liquid or solution 10 either hot or cold within the interior space 180. There are a plurality of insulating metal materials that may be used such as, but not limited to: stainless steel, titanium, aluminum, or combinations thereof. In one embodiment, the insulated housing 170 may have multiple layers of insulating metal. In another embodiment, the insulated housing 170 may be vacuum sealed for even greater insulation. In the insulated embodiment, the device 100 may further be constructed of the same elements and components as FIG. 1, and FIG. 2. In varying embodiments, the insulated embodiment, may have an array of different components such as a threaded cap 160 without a nozzle. In this embodiment, the cap 160 may be twisted on and off the insulated housing 170 to access the liquid 10. The dispenser 100 has a thermometer 181 or other gauge to show the user the temperature of the material or solution within the dispenser 100.

Figure 4:
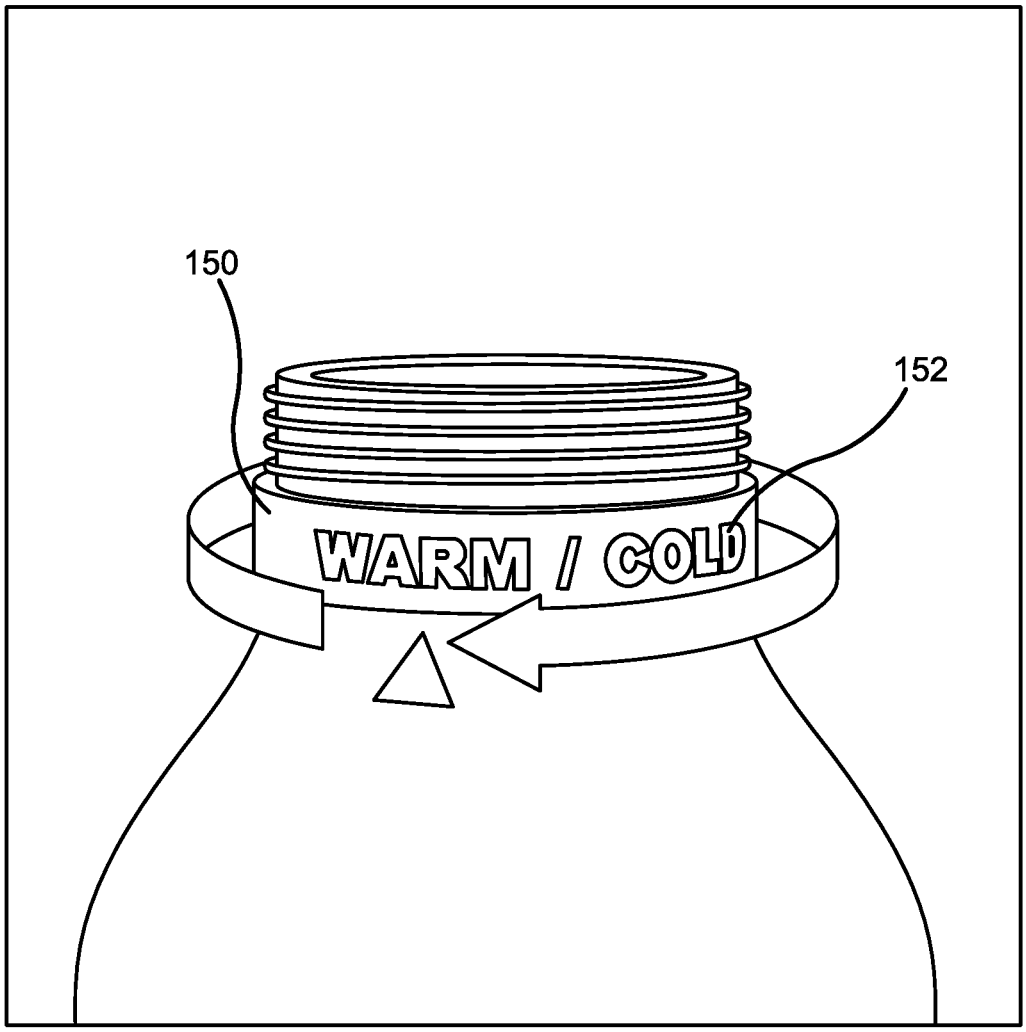
FIG. 4 illustrates a perspective view of one potential embodiment of an automated disposable dispenser of the present invention in accordance with the disclosed architecture.

FIG. 4 illustrates a perspective view of one potential embodiment of an automated disposable dispenser 100 of the present invention in accordance with the disclosed specification. In the insulated embodiment, the dispenser 100 have at least one dial 150 that may be twisted to allow a user to know whether the liquid 10 is hot or cold within the interior space 180. Further, the dial 150 may have indicia 152 that displays whether the liquid 10 is hot or cold. The indicia 152 may be any indicia such as a pattern, a logo, an emblem, an image, a symbol, a design, a letter, a word, a character, an animal, an advertisement, a brand, or any combination therein to allow a user to know if the liquid 10 is hot or cold.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "automated disposable dispenser" and "device" are interchangeable and refer to the automatic dispensing disposable bottle device 100 of the present invention.

Notwithstanding the foregoing, the automatic dispensing disposable bottle or container device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the automated disposable dispenser device 100 as shown in the FIGS. are for illustrative purposes only, and that many other sizes and shapes of the automated disposable dispenser device 100 are well within the scope of the present disclosure. Although the dimensions of the automated disposable dispenser device 100 are important design parameters for user convenience, the automated disposable dispenser device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A dispenser comprising:

a housing comprised of a wall, a bottom surface and a top defining an interior space, the interior space housing a supply of material or solution to be dispensed, wherein a first diameter value of the top is one-third to one-half less than that of a second diameter value of the housing;

a gripping surface provided on the housing, wherein:

the gripping surface comprises a non-slip rubber material, and the non-slip rubber material is formed into a plurality of undulating ridges disposed successively across an outer surface of the housing;

a cap provided on the top of the housing, the cap having a nozzle for dispensing the supply of material or solution within the housing;

a motion sensor, wherein the motion sensor is a passive infrared sensor;

a light source connected to the motion sensor, wherein:

the light source comprises a light indicator that illuminates based upon how much of the supply of solution remains in the interior space, and the passive infrared sensor activates the light source upon detecting movement;

a straw provided in the supply of material or solution and connected to the nozzle; and a motor connected to the motion sensor for supplying the supply of material or solution to the nozzle, wherein the passive infrared sensor activates the motor upon detecting movement.

2. The dispenser as recited in claim 1, wherein the motor pulls the supply of material or solution through the straw to the nozzle.

3. The dispenser as recited in claim 2 further comprising a meter provided in the motor and connected to a flow regulator to control an amount of solution dispensed.

4. The dispenser as recited in claim 2 further comprising a timer provided in the motor and connected to a flow regulator to control a time between dispensing cycles.

5. The dispenser as recited in claim 1 further comprising a movable tray for catching the supply of material or solution dispensed from the nozzle.

6. The dispenser as recited in claim 5, wherein the movable tray is located on the bottom surface of the housing.

7. The dispenser as recited in claim 1 further comprising a fastener disposed on the bottom surface.

8. The dispenser as recited in claim 7, wherein the fastener is one of a magnet, a suction cup, a removable or repositionable adhesive, a hook and loop fastener, or a combination thereof.

9. An automatic dispensing bottle comprising:

a housing having a plurality of walls, a bottom, and a top defining an interior space containing a reservoir of solution to be dispensed, wherein a first diameter value of the top is one-third to one-half less than that of a second diameter value of the housing;

a gripping surface provided on the housing, wherein:

the gripping surface comprises a non-slip rubber material, and the non-slip rubber material is formed into a plurality of undulating ridges disposed successively across an outer surface of the housing;

a motion sensor, wherein the motion sensor is a passive infrared sensor;

a bottom surface having a fastener for holding the housing to a surface;

a nozzle provided in a cap on the top of the housing, a light source connected to the motion sensor, wherein:

the light source comprises a light indicator that illuminates based upon how much of the supply of solution remains in the interior space, and the passive infrared sensor activates the light source upon detecting movement;

a straw connected to the nozzle that extends to the reservoir of solution; and a motor activated by the motion sensor to dispense the solution from the reservoir to the nozzle, wherein the passive infrared sensor activates the motor upon detecting movement.

10. The automatic dispensing bottle as recited in claim 9, wherein the motor comprises a timer and a meter to control a flow of the solution to the nozzle.

11. The automatic dispensing bottle as recited in claim 10, wherein the timer and motor are connected to a flow regulator in the straw.

12. The automatic dispensing bottle as recited in claim 9, wherein a fastener and a moveable tray are positioned on the bottom surface, and further wherein the fastener is one of a magnet, a suction cup, a removable or repositionable adhesive, a hook and loop fastener or a combination thereof.

13. A disposable dispenser comprising:

a housing having a supply of solution, the supply of solution contained within an interior space defined by walls, a bottom and a top, wherein a first diameter value of the top is one-third to one-half less than that of a second diameter value of the housing;

the bottom having a fastener for holding the housing to a surface and the fastener including one of magnetic, suction cup, removable or repositionable adhesives, hook and loop fasteners, or combinations thereof;

a gripping surface provided on the housing, wherein:

the gripping surface comprises a non-slip rubber material, and the non-slip rubber material is formed into a plurality of undulating ridges disposed successively across an outer surface of the housing;

a nozzle provided on a cap on the top of the housing;

a motion sensor, wherein the motion sensor is a passive infrared sensor;

a motor connected to the motion sensor to dispense from the supply of solution, wherein the passive infrared sensor activates the motor upon detecting movement;

a battery connected to the motor and the motion sensor; and a light source connected to the motion sensor, wherein:

the light source comprises a light indicator that illuminates based upon how much of the supply of solution remains in the interior space, and the passive infrared sensor activates the light source upon detecting movement.

* * * * *